US008397740B2

(12) United States Patent
Price et al.

(10) Patent No.: US 8,397,740 B2
(45) Date of Patent: Mar. 19, 2013

(54) INK TANK FOR INKJET PRINTER

(75) Inventors: Brian G. Price, Pittsford, NY (US); David R. Scott, Brockport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 13/313,060

(22) Filed: Dec. 7, 2011

(65) Prior Publication Data

US 2012/0073699 A1 Mar. 29, 2012

Related U.S. Application Data

(62) Division of application No. 12/139,544, filed on Jun. 16, 2008, now Pat. No. 8,132,899.

(51) Int. Cl.

| | |
|---|---|
| ***B08B 7/00*** | (2006.01) |
| ***B08B 9/02*** | (2006.01) |
| ***E03B 1/00*** | (2006.01) |
| ***E03B 9/00*** | (2006.01) |
| ***F17D 3/00*** | (2006.01) |
| ***B41J 2/175*** | (2006.01) |

(52) U.S. Cl. ..... 137/15.01; 347/86

(58) Field of Classification Search ..... None
See application file for complete search history.

(56) References Cited

U.S. PATENT DOCUMENTS

| | | | | |
|---|---|---|---|---|
| 5,682,189 | A | 10/1997 | Takagi | |
| 5,703,633 | A | 12/1997 | Gehrer et al. | |
| 6,502,933 | B2 * | 1/2003 | Lim et al. | 347/86 |
| 6,880,921 | B2 | 4/2005 | Aponte et al. | |
| 7,252,378 | B2 | 8/2007 | Lee | |
| 7,290,871 | B2 | 11/2007 | Greer et al. | |
| 2003/0117451 | A1 | 6/2003 | Usui et al. | |
| 2006/0001708 | A1 | 1/2006 | Greer et al. | |

FOREIGN PATENT DOCUMENTS

WO 2007/138624 12/2007

OTHER PUBLICATIONS

Boycott, A.E., *Nature*, 104: 532, 1920.

* cited by examiner

*Primary Examiner* — Matthew Luu
*Assistant Examiner* — Renee I Wilson
(74) *Attorney, Agent, or Firm* — Peyton C. Watkins

(57) ABSTRACT

The present invention relates to an ink tank for an ink jet printer. The invention further relates to a method of manufacturing the ink tank, as well as well as a method of refilling the ink tank. The ink tank includes an ink tank body and an ink tank lid bonded to the ink tank body at a bond joint. The ink tank lid comprises an opening that leads to a holding area that is adapted to contain a capillary media therein. The holding area comprises a wall that forms a boundary between the capillary media and an enclosure defined by the ink tank body and the ink tank lid. The opening is sized to permit an insertion and removal of the capillary media to and from the holding area when the ink tank lid is bonded to the ink tank body at the bond joint.

7 Claims, 7 Drawing Sheets

INK TANK FOR INKJET PRINTER

CROSS REFERENCE TO RELATED APPLICATIONS

This application is a divisional of U.S. patent application Ser. No. 12/139,544 filed Jun. 16, 2008 now U.S. Pat. No. 8,132,899 entitled "Ink Tank for Inkjet Printers" by Brian G. Price et al, the disclosure of which is incorporated herein in its entirety. Reference is made to commonly-assigned, U.S. patent application Ser. No. 12/139,533 filed Jun. 16, 2008 entitled "Liquid Storage Tank Including A Pressure Regulator" in the name of Brian G. Price the disclosure of which is incorporated herein by reference.

FIELD OF THE INVENTION

The present invention relates generally to the field of liquid storage tanks, and in particular to ink tanks for inkjet printers.

BACKGROUND OF THE INVENTION

A component of nearly all modern day inkjet printers is an ink tank that delivers ink to the printhead in order to render a printed image. The ink tank prevents leakage of the ink during manufacture, storage, transportation, and the printing operation itself. In particular, once the ink tank is in fluidic communication with the printhead, an appropriate range of negative fluidic pressure must be maintained at the printhead nozzles, so that ink does not weep out of the printhead nozzles. The ink tank should be capable of containing the ink even under conditions where the pressure within the ink tank changes due to environmental conditions. For example, pressure variations within an ink tank can occur due to changes in ambient temperature such as when an ink tank is stored at elevated temperatures in a warehouse or a particular geographic region where high temperatures are encountered. Pressure variations within an ink tank can also occur when the ink tank is subjected to changes in barometric pressure such as transporting the ink tank in an airplane or a geographic elevation high above sea level. To this extent, most modern day inkjet ink tanks are designed with some means of pressure regulation to provide a suitable range of negative pressure to the printhead nozzles and to prevent loss of ink during substantial changes in temperature or pressure.

Various designs for regulating the pressure within an inkjet ink tank are known including, bubble generators, reverse bubblers, diaphragms, capillary media and bags. Each of these designs has limitations in the overall system performance of the tank. Ink tanks that use capillary media, such as a foam, fiber or felt, to store ink as a means for pressure regulation have the disadvantage that ink resides directly in the small passages of the capillaries. This is particularly problematic for pigmented inks since pigment particles having sizes greater than about 20 nanometers in diameter are subject to settling phenomena, for example, the pigment particles remaining lodged within pores or interstices of the capillary media. This is certainly the case for most modern day pigmented inks that have particle diameters in the range of 20 to 500 nanometers.

Pigmented ink can remain in an ink tank for several years from the time of manufacture through storage and use of the ink tank and this provides ample opportunity for the pigment particles to settle. Ink tank designs where ink is stored in capillary media leads to a situation where pigment particles are restricted in motion within the small passages of the capillary media. This restriction in particle movement is further complicated by the so-called Boycott Effect, wherein the observed sedimentation rate is increased in proportion to the available horizontal surface area within a capillary. For a more detailed description of the Boycott Effect see, Boycott, A. E., Nature, 104: 532, 1920. Both complications lead to an inhomogeneous distribution of pigment particles within the ink carrier fluid that can manifest itself as defective images during the printing process. For example, the non-homogeneous pigmented ink can result in images having a textured appearance reminiscent of a wood grain appearance if the pigmented ink is stored in the capillary media within an ink tank. This leads to a limitation in the selection of the pigment particle size since larger particles, which can be beneficial to providing higher optical density in printed regions, are disadvantaged from a settling and homogeneity standpoint when stored in a capillary media.

A second limitation for ink tanks using capillary media is the wasted ink associated with the capillary media. Ink tank designs where capillary media is used to store ink can result in a finite amount of ink that remains trapped in the capillary media at the end of the useful life of the tank. Ink that remains trapped is effectively wasted ink as it is not available for transport to the printhead and ultimately for printing of an image. It would be desirable to minimize the amount of ink trapped in the capillary media of an ink tank.

Ink tanks can be labor intensive and expensive to manufacture. In many ink tank designs, the lid of the ink tank must be tightly secured or bonded to the ink tank body after the insertion of the capillary media used for pressure regulation so that no ink leaks from the tank body. This can present a problem of properly aligning the capillary media during manufacturing of the ink tank and typically the capillary media must be inserted into the tank body prior to the bonding of the lid to the tank body. Prior art ink tank designs have the common feature that the capillary media resides between the ink tank body and the bond joint between the ink tank body and the ink tank lid. Furthermore, once the lid is bonded to the ink tank body (typically using a vibration or laser welding operation) it is impossible to remove the capillary media from the ink tank body without breaking the bond between the lid and the tank body or otherwise compromising the ink tank body itself. In most circumstances, this presents a major impediment to reuse of the ink tank since the ink tank can be damaged upon breaking the bond between the ink tank body and lid.

Refilling an ink tank with new ink once the initial ink is consumed may offer the potential for a cost savings since a new ink tank does not need to be manufactured. However, there are problems associated with refilling and reusing ink tanks where the initial ink in the tank has been consumed. For example, ink tank designs where ink is stored in capillary media results in contamination of the capillary media with the ink. In some cases, for example dye-based ink, it can be possible to refill the ink tank with the same colored ink provided that the initial ink retained in the capillary media does not adversely affect the newly filled ink. This is more problematic for pigment-based inks since ink trapped in the interstitials of the capillary media can flocculate and dry out as ink is consumed. Any ink refilled into an ink tank having the same starting capillary media would be contaminated with original pigment ink trapped in the capillary media. With both dye and pigment based inks, the ink tank would need to be re-filled with the same colored ink since any color contamination would greatly affect the performance of the ink. Even if it is possible to refill and reuse an ink tank, repeated refilling and reuse will successively degrade the printing performance, and particularly so for pigmented inks.

To this extent, it would be desirable to provide an ink tank that can be easily reused and refilled in a manner which permits the original capillary media in the ink tank to be replaced with a new capillary media without the need to compromise the structure of the ink tank body or bond joint between the ink tank body and ink tank lid. An ink tank design where the capillary media could be easily replaced, the ink tank easily flushed to remove original ink and the tank refilled with any color ink would be desirable. At present, ink tanks known in the art of ink jet printing do not achieve this desirable set of features.

Designs are known for ink tanks having a secondary ink storage chamber located within the main ink tank where the secondary ink storage chamber includes capillary media, such as U.S. Pat. Nos. 5,682,189, 5,703,633, 6,880,921, 7,252,378, and 7,290,871. Designs of this type suffer from the limitation that pigmented ink stored in the secondary ink chamber would be subject to settling and non-homogeneity during printing as discussed above. Designs of this type also have the limitation that the capillary media resides between the ink tank body and the bond joint between ink tank body and ink tank lid.

The limitations in the design of ink tanks for inkjet printers where capillary media is used indicates the need for an ink tank that would be capable of storing ink, even during conditions where pressure excursions can exist, where ink is not intended to be stored within the capillary media at normal operating pressures. There is also a need for a simple means of manufacturing an ink tank that contains capillary media as a means for pressure regulation. A need also exists for an ink tank which can be reused in a simple and effective manner.

SUMMARY OF THE INVENTION

The present invention is directed to overcoming one or more of the problems set forth above. Briefly summarized, according to one aspect of the present invention, there is provided an ink tank having an ink tank body bonded to an ink tank lid at a bond joint. The ink tank lid forms an enclosure or holding area that contains a capillary media. The capillary media resides outside the ink tank body and is not between the ink tank body and the bond joint between the ink tank and ink tank lid.

More specifically, the present invention relates an ink tank that comprises: an ink tank body; and an ink tank lid bonded to the ink tank body at a bond joint. The ink tank body and the ink tank lid bonded to the ink tank body at the bond joint define an enclosure therein. The ink tank lid comprises an opening which leads to a holding area, with the holding area containing a capillary media therein. The holding area comprises a wall which forms a boundary between the capillary media and the enclosure, with the opening being sized to permit an insertion and removal of the capillary media to and from said holding area with the ink tank lid bonded to the ink tank body at the bond joint.

The present invention further relates to an ink tank that comprises an ink tank body; and an ink tank lid bonded to the ink tank body at a bond joint. The ink tank body and the ink tank lid bonded to the ink tank body at the bond joint define an enclosure therein. The ink tank lid comprises a first opening which is sized to permit an insertion and removal of a holding area unit, with the holding area unit comprising a second opening and containing a capillary media therein. The holding area unit comprises a wall which forms a boundary between the capillary media and the enclosure, with the second opening being sized to permit an insertion and removal of the capillary media to and from the holding area unit with the ink tank lid bonded to the ink tank body at the bond joint.

The present invention further relates to a method of manufacturing an ink tank which comprises: (a) attaching an ink tank lid to an ink tank body so as to form an enclosure therein, with the ink tank body having a supply port; (b) providing for an opening on the ink tank lid that leads to a holding area, wherein a wall that defines the holding area forms a boundary between the enclosure and the holding area; (c) inserting a capillary media into the holding area through the opening; and (d) filling the enclosure with ink through the supply port, wherein at least the above step (c) is performed with the ink tank lid attached to the ink tank body.

The present invention further relates to a method of refilling an ink tank where ink in the ink tank has been previously consumed by a user. The ink tank of the invention has an ink tank lid that is bonded to an ink tank body. The method comprises: (a) removing a protective cover from the ink tank lid, with the ink tank lid comprising an opening which leads to a holding area, and the holding area containing a capillary media therein; (b) removing the capillary media from the holding area through the opening in the ink tank lid; (c) inserting a new capillary media into the holding area through the opening; and (d) refilling the ink tank with ink through a supply port on the ink tank body, wherein at least the above steps (a) through (d) are performed with the ink tank lid being bonded to the ink tank body.

The present invention also relates to a method of refilling an ink tank where ink in the ink tank has been previously consumed by a user. The ink tank has an ink tank lid that is bonded to an ink tank body. The method comprises (a) removing a capillary media from a holding area defined by the ink tank lid through an opening in the ink tank lid; (b) inserting a new capillary media into the holding area through the opening; and (c) refilling the ink tank with ink through a supply port on the ink tank body, wherein the above steps (a) through (c) are performed with the ink tank lid being bonded to the ink tank body.

BRIEF DESCRIPTION OF THE DRAWINGS

The above and other objects, features, and advantages of the present invention will become more apparent when taken in conjunction with the following description and drawings, wherein identical reference numerals have been used, where possible, to designate identical features that are common to the figures, and wherein.

To facilitate understanding, identical reference numerals have been used, where possible, to designate identical elements that are common to the figures.

DETAILED DESCRIPTION OF THE INVENTION

The present description will be directed in particular to elements forming part of, or cooperating more directly with, an apparatus in accordance with the present invention. It is to be understood that elements not specifically shown or described may take various forms well known to those skilled in the art.

Figure 1:
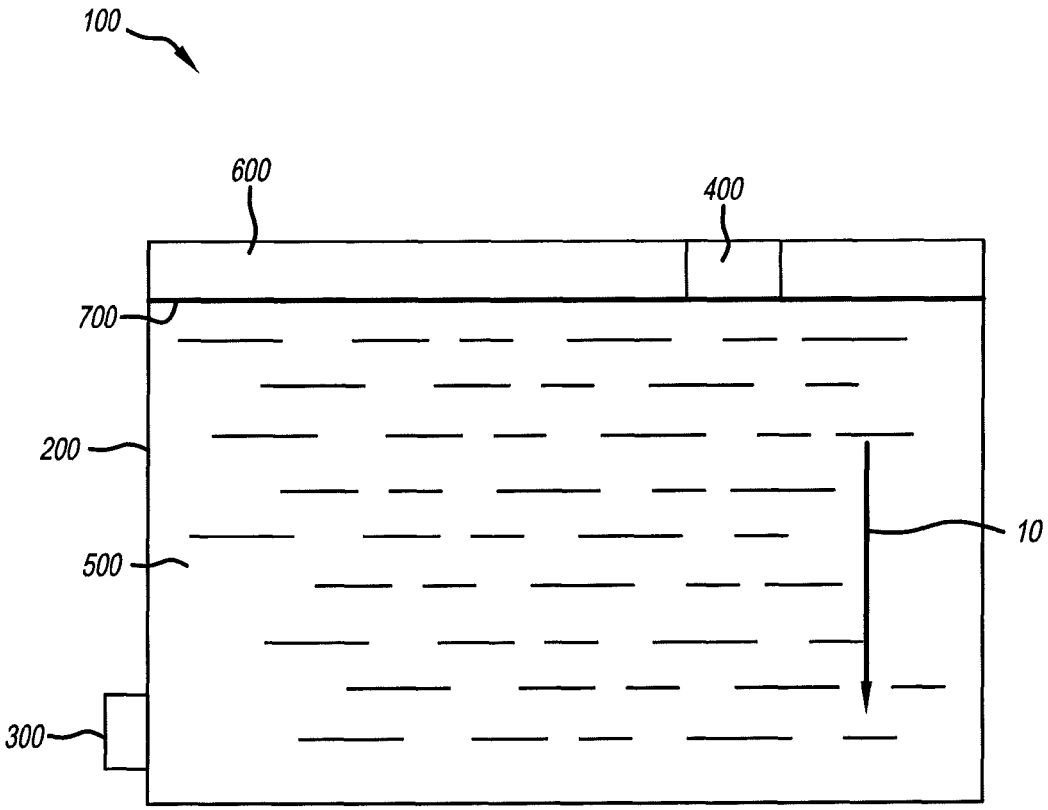
FIG. 1 (Prior Art)
FIG. 1 is a cross-sectional view of a prior art ink tank having capillary media in the main tank body, the capillary media residing between the ink tank body and the bond joint between the ink tank body and lid.
Figure 2:
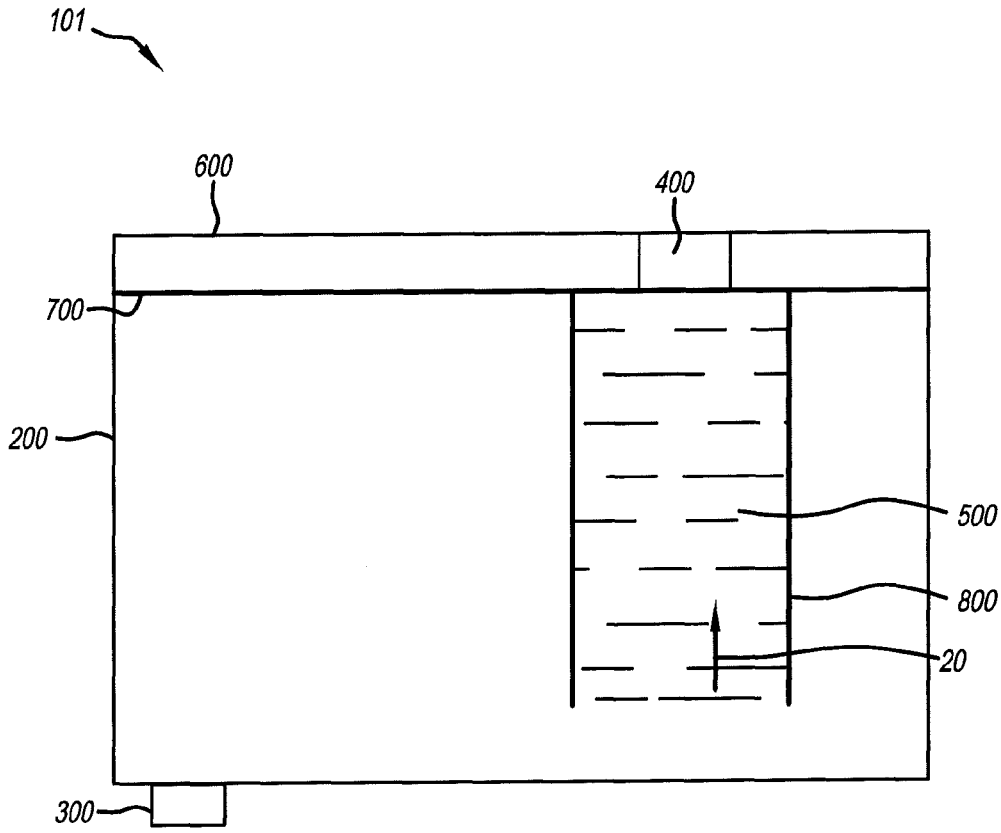
FIG. 2 (Prior Art)
FIG. 2 is a cross-sectional view of a prior art ink tank having a secondary ink storage chamber filled with capillary media, the capillary media residing between the ink tank body and the bond joint between the tank body and lid.

Prior art liquid tanks known in the art of inkjet printing are exemplified by FIGS. 1 and 2. FIG. 1 exemplifies a prior art inkjet ink tank 100 having a vent 400 to atmosphere at the top of the ink tank and a capillary media member 500 positioned within an ink tank body 200 used for storing ink. Ink stored within the ink tank 100 of FIG. 1 is supplied to the printhead through a supply port 300 that directly interfaces with the capillary media member 500. In this arrangement, a pigmented ink would be directly stored in the interstitials of the capillary media member 500 for the entire useful lifetime of the ink tank and would experience the limitations discussed above. Ink tank 100 has a lid 600 that is bonded to the ink tank body 200 at a bond joint or seal 700. The prior art ink tank 100 exemplified in FIG. 1 has capillary media 500 that resides between the ink tank body 200 and the bond joint 700 between the lid 600 and ink tank body 200. More specifically, in FIG. 1, capillary media 500 resides within an enclosure defined by ink tank body 200 and lid 600 bonded to ink tank body 200 at bond joint 700.

In order to manufacture ink tank 100 exemplified by FIG. 1, the capillary media 500 is inserted into the open tank body 200 in the direction indicated by arrow 10 and then the lid 600 is bonded to the ink tank body 200 at the bond joint 700. Ink tanks exemplified by FIG. 1 have the additional manufacturing limitation that ink must be filled directly into the capillary media either before or after the lid 600 is bonded to the ink tank body 200. The prior art ink tank 100 exemplified by FIG. 1 is not easily cleanly flushed and reused once ink is consumed from the ink tank. In order to cleanly refill the ink tank 100 with ink, the existing capillary media 500 would need to be replaced with a new capillary media, as ink residue and pigment becomes trapped in the capillary media 500 and cannot be flushed cleanly away inside the ink tank 100. Since the vent hole 400 is substantially smaller than the capillary media 500, it is not possible to remove the capillary media 500 through the vent hole 400 once the lid 600 is bonded to the ink tank body 200. The only other possible way to remove the capillary media 500 from the ink tank body 200 would be to break the bond joint 700 or the tank body 200 itself. This would render the ink tanks exemplified by FIG. 1 as very difficult to reuse cleanly once the initial ink contained in the ink tank was consumed.

FIG. 2 exemplifies a prior art ink tank 101 having vent 400 to atmosphere at the top wall of the ink tank, ink tank body 200 and a secondary ink storage compartment or chamber 800 that includes capillary media member 500. The secondary ink storage compartment 800 of prior art ink tank 101 is open to the ink tank body 200 to allow open fluid communication between the ink storage compartment 800 and the ink tank body 200. The prior art ink tank 101 suffers from the limitation that pigmented ink resides in the capillary media 500 contained within the secondary storage compartment 800. Ink tank 101 includes lid 600 bonded to the ink tank body 200 at bond joint 700. Ink tank 101 exemplified in FIG. 2 has capillary media 500 that resides between the ink tank body 200 and the bond joint 700 between the lid 600 and ink tank body. More specifically, capillary media 500 resides within an enclosure or area defined by ink tank body 200 and lid 600 bonded to ink tank body 200 at bond joint 700.

In order to manufacture ink tank 101 exemplified by FIG. 2, the capillary media 500 would be inserted into the secondary ink storage chamber 800 in a direction indicated by arrow 20 and then the lid 600 would be bonded to the ink tank body 200 at the bond joint 700. Since the vent hole 400 is substantially smaller than the secondary ink storage chamber 800, it is not possible to remove the capillary media 500 through the vent hole once the lid 600 is bonded to the ink tank body 200. The only other possible way to remove the capillary media 500 from the secondary ink storage chamber 800 would be to break the bond joint 700 or the ink tank body 200 itself. This would render ink tanks exemplified by FIG. 2 as very difficult to cleanly reuse once the initial ink contained in the ink tank was consumed.

Figure 3:
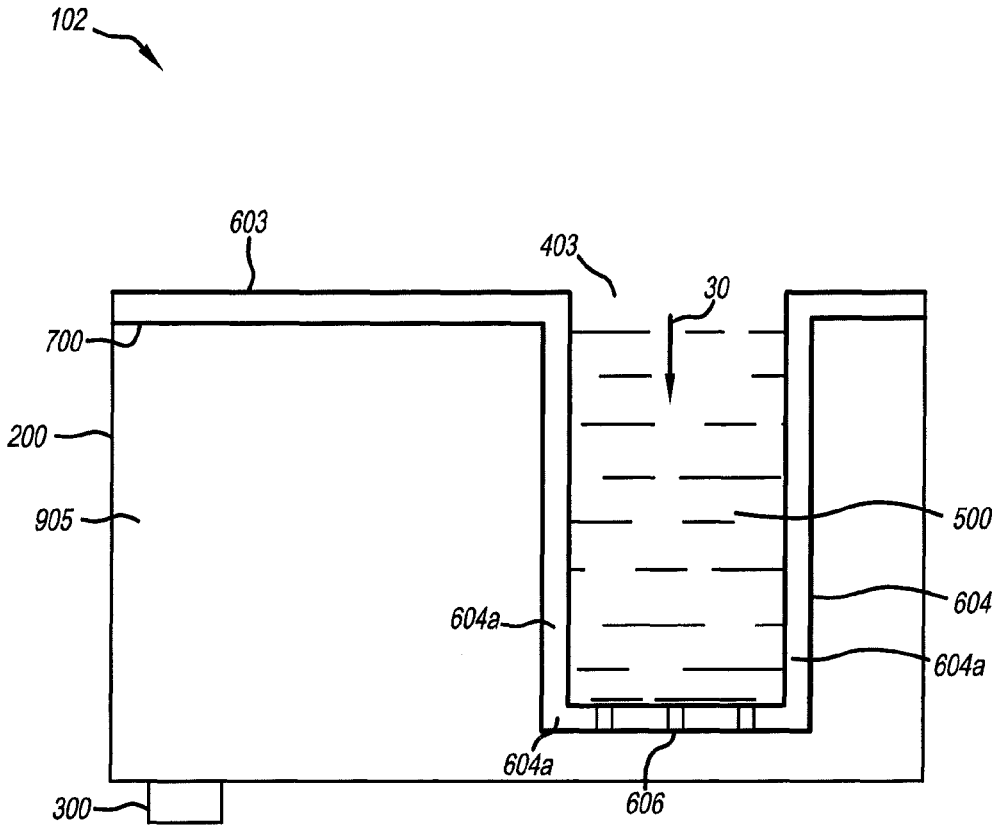
FIG. 3 is a cross-sectional view of an exemplary embodiment of an ink tank of the present invention having a capillary media residing outside of the ink tank body, the capillary media not residing between the ink tank and the bond joint between the ink tank body and lid.

FIG. 3 exemplifies an embodiment of an ink tank 102 of the present invention. The ink tank 102 includes ink tank body 200 and a lid 603. The lid 603 is bonded to ink tank body 200 at bond joint 700. The bond joint 700 can be formed by any technique known in the art and in two exemplary embodiments the bond joint 700 is a vibration weld or a laser weld between the ink tank body 200 and the ink tank lid 603. Ink is supplied from ink tank 102 through supply port 300 that is located on a portion (for example, a lower portion) of the ink tank body 200 and which is preferably located on the bottom wall of the ink tank 102. The lid 603 of ink tank 102 includes a depression on the outer surface of the lid 603 extending into the ink tank body 200 that forms an enclosure or holding area 604 capable of holding a capillary media 500 therein. The lid 603 forming the enclosure or holding area 604 having capillary media 500 contained therein creates a geometry such that the capillary media 500 resides outside an enclosure or area 905 defined by the ink tank body 200 and the ink tank lid 603 bonded to the ink tank body 200 at bond joint 700. That is, the capillary media 500 is not between the ink tank body 200 and the bond joint 700 between the ink tank body 200 and lid 603. More specifically, enclosure or area 905 defined by ink tank body 200 and lid 603 bonded onto ink tank body 200 at bond joint 700 does not include capillary media 500. In accordance with the present invention, the capillary media 500 is provided within enclosure or holding area 604.

The depression in the outer surface of lid 603 forms the enclosure or holding area 604 in a geometry such that an opening 403 at the top of the lid 603 is large enough to insert and/or remove capillary media 500 during the manufacture and reuse of the ink tank 102. This has several advantages over prior art ink tank designs. Therefore, unlike prior art tank designs, the lid 603 of ink tank 102 can be bonded to the ink tank body 200 at the bond joint 700 prior to insertion of the capillary media 500. Once the ink is consumed from the ink tank 102, the capillary media 500 can be changed from the enclosure or holding area 604 formed in the lid 603 by simply removing the capillary media 500 from the enclosure or holding area 604 through the opening 403 while lid 603 is bonded to the ink tank body 200 at bond joint 700; flushing the residual ink out of ink tank 102; and inserting a new capillary media through opening 403 in the direction indicated by arrow 30 into the enclosure or holding area 604. New ink could then be filled into the ink tank body 200 through a variety of methods, such as, for example, turning the ink tank over and refilling the ink tank body through port 300, or using a dispenser to dispense ink into the ink tank body through port 300, thereby providing a simple means of refilling the ink tank. Therefore, unlike prior art ink tanks, the capillary media 500 can be changed without the need to break the bond joint 700 or otherwise compromise the integrity of the ink tank body 200.

The lid 603 forms enclosure or holding area 604 that can be in the form of a tube, cylinder, or other hollow geometric shape and extends downward from the lid 603 unsupported by the sidewalls of the ink tank body 200. In accordance with a feature of the present invention, enclosure or holding area 604 comprises a wall 604*a* that forms a boundary between the capillary media 500 and the enclosure 905. Further, opening 403 is sized to permit an insertion and/or removal of capillary media 500 from enclosure or holding area 604 without having to remove bonded lid 603, since walls 604*a* separate enclosure 905 from capillary media 500 located in holding area 604 which is outside of enclosure 905. The upper portion of the enclosure or holding area 604 formed in the lid 603 can taper at an angle to a lower portion of the enclosure. Such geometries can allow for design of an ink tank 102 that can accommodate different sized and shaped capillary media members and can provide extra protection against liquid leakage during substantial pressure excursions.

Figure 5:
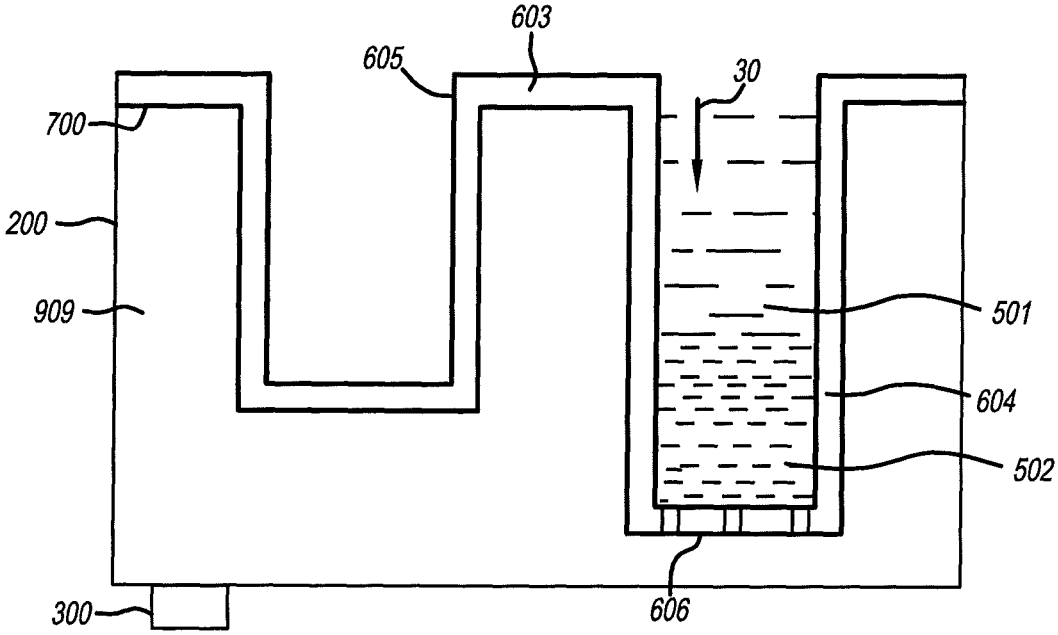
FIG. 5 is a cross-sectional view of an exemplary embodiment of an ink tank of the present having a protrusion from the lid and a capillary media residing outside of the tank body, the capillary media not residing between the ink tank and the bond joint between the ink tank body and lid.

In one exemplary embodiment shown in FIG. 5 the enclosure or holding area 604 formed in the lid 603 includes a first capillary media 501 and a second capillary media 502. The first capillary media 501 can be designed such that it has a larger pore size (lower capillarity) than the second capillary media 502 and is primarily responsible for containment of liquid in the event of an overflow past the second capillary media 502. The second capillary media 502 is designed such that it has a smaller pore size (higher capillarity) than the first capillary media 501. The second capillary media 502 does not need to be of any particular height, but only needs to be the final barrier for air to the liquid, so that it is the pressure-determining air-liquid-media interface. It is recognized that the embodiment shown in FIG. 3 can also include first and second capillary media 501, 502 rather than just capillary media 500.

Any of the known capillary media types can be used for the capillary media 500, 501 and 502. Suitable materials for capillary media of the present invention include foams, felts or fibers. Foams useful as capillary media can be made from synthetic materials such as, for example: polyurethanes, polyesters, polystyrenes, polyvinylalcohol, polyethers, neoprene, and polyolefins. Fibers or felts useful as capillary media can be made from synthetic materials such as, for example: cellulosics, polyurethanes, polyesters, polyamides, polyacrylates, polyolefins, such as polyethylene, polypropylene, or polybutylene, polyacrylonitrile, or copolymers thereof. Additional examples of capillary media materials are exemplified in PCT International Publication Number WO 2007/138624, which is incorporated herein in its entirety by reference.

Figure 4:
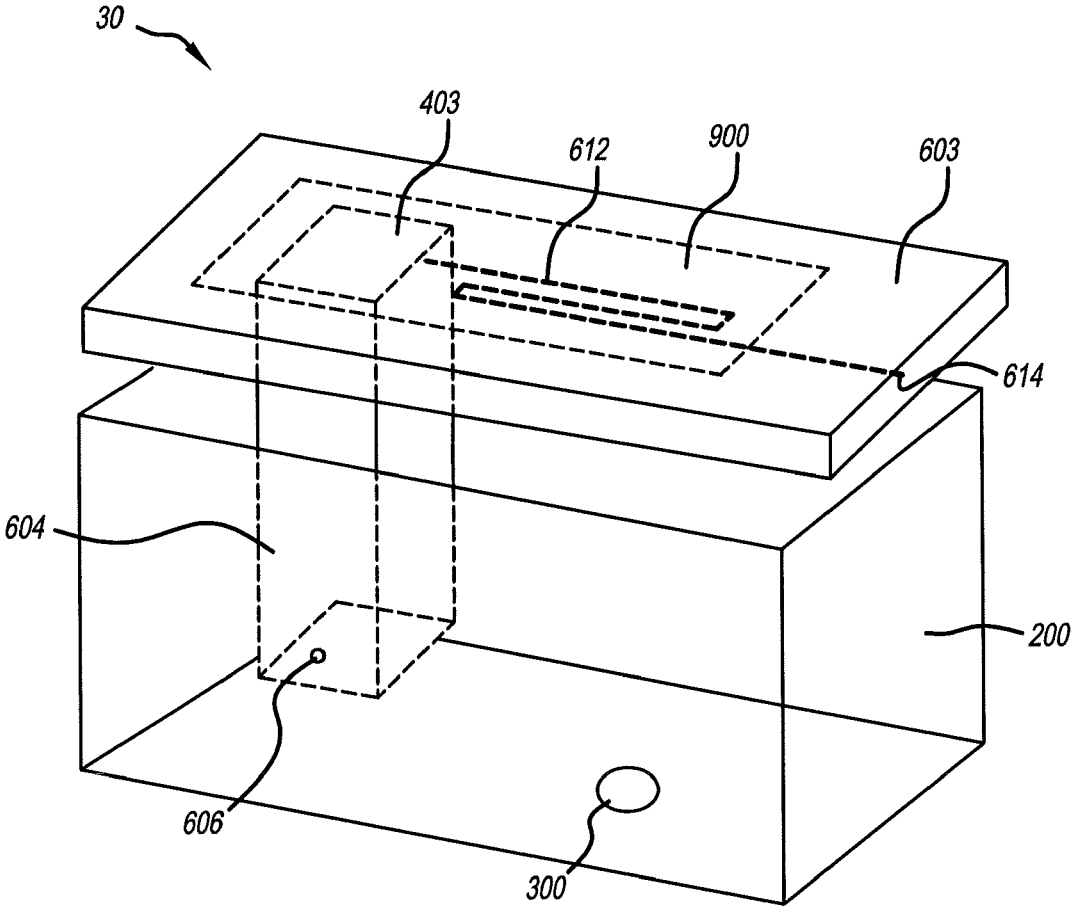
FIG. 4 is a projection view showing the lid and ink tank body of an exemplary embodiment of an ink tank of the present invention.

In one exemplary embodiment, shown in FIGS. 3 and 4, a portion or a section of wall 604*a* of the enclosure or holding area 604 formed in the lid 603 includes one or more holes 606 that are small enough to inhibit ink contained in the enclosure 905 of ink tank body 200 from entering the enclosure or holding area 604 during normal operating pressures. In this arrangement, the one or more holes 606 can be formed during the manufacture of the lid 603 (for example, by injection molding), or can be formed as a separate step, such as a drilling or machining operation after formation of the lid. Optionally, the one or more holes 606 can complete the enclosure or holding area 604 by attaching a separate piece to an open portion of the enclosure or holding area. A separate filter, frit, screen or surface with a preformed hole or holes 606 can be attached by a welding, threading or adhesive operation to the lid 603 to complete the enclosure or holding area 604. Preferred hole arrangements are disclosed in co-pending commonly assigned application (D-94287).

The ink tank 102 of the present invention is vented to the atmosphere through the opening 403, shown in FIGS. 3 and 4 that forms the enclosure or holding area 604 in the lid 603. For example, a winding groove 612 (FIG. 4) can be provided in a covered portion of the outer surface of lid 603, such that the groove 612 extends from opening 403 to an uncovered portion of the lid 603 to form a vent 614. In the preferred embodiment, the opening 403 is sized so that the capillary media member 500, 501 or 502 can be easily inserted and removed through the opening 403. As liquid is consumed from the ink tank 102 through the supply port 300, air can enter the ink tank through the opening 403 and enclosure or holding area 604 formed in the lid 603 to equalize the pressure within the ink tank. The opening 403 is located in a position on the ink tank 102 such that air can only flow into the tank through the enclosure or holding area 604 formed in the lid 603. The opening 403 can be covered on the inside of the ink tank 102 by a semi-permeable membrane (not shown). The opening 403 can be overlaid from the outside of the ink tank 102 by a protective cover 900, shown in FIG. 5, such as a label 900 that is adhered to the lid 603 by a thermally cured adhesive or a pressure sensitive adhesive in order to aid in keeping liquid from migrating out of the liquid tank. Alternatively, a portion of lid 603 including opening 403 and groove 612 can be overlaid by a gasketed protective cover (not shown) that can be attached over the lid using mechanical fasteners such as screws.

Ink tanks of the present invention can have one or more protrusions 605 from the lid 603 extending downwards into the ink tank body 200 or enclosure 905 as exemplified by FIG. 5. These protrusions 605 are part of the lid 603 and do not contain capillary media. The protrusions 605 can function to adjust the available volume for storing ink within the ink tank body 200. This provides a manufacturing advantage so that a single tank body 200 can be manufactured and corresponding lids 603 having variable shaped protrusions 605 are separately manufactured, thereby providing a means to control variable ink fill volumes within the ink tank 102.

Ink tanks of the present invention exemplified by FIGS. 3, 4 and 5, have the additional advantage that ink can be filled into the ink tank 102 without filling the capillary media with ink. In one exemplary embodiment, an ink tank can be manufactured according to the following steps: a) an ink tank body 200 having an open ink tank supply port 300 on a lower portion of the tank body is bonded at a bond joint 700 to a lid 603 having an enclosure or holding area 604 and a groove 612 formed therein, b) a capillary media 500 is inserted into the enclosure or holding area 604 through an opening 403 formed in the tank lid 603, c) the ink tank 102 is oriented such that ink is filled into the ink tank body 200 through the supply port 300, d) the supply port 300 is closed, and e) the groove 612 and the opening 403 from the enclosure or holding area 604 in the lid 603 are overlaid with a protective cover 900 to provide a vent 614 to atmosphere.

In a second alternative manufacturing embodiment, step b), involving insertion of the capillary media 500 into the enclosure 604, can occur after step d) and before step e) shown above. In other words, the ink tank 102 can be filled without the capillary media 500 inserted into the enclosure, and the capillary media 500 can be inserted prior to sealing the lid with a protective cover 900. Ink tanks manufactured by the method above avoid the limitation of filling the ink tank through the capillary media. This has the advantage that ink is not introduced into the capillary media and all limitations associated with this are avoided.

Ink tanks of the present invention exemplified by FIGS. 3,4 and 5, have the additional advantage that the ink tank can be reused or refilled in a simple and effective manner. In one exemplary embodiment, a method of refilling an ink tank can be achieved according to the following steps: after ink is consumed from an ink tank 102, a) the protective cover 900 is removed from the lid 603, b) the existing capillary media 500 is removed from the enclosure or holding area 604, c) optionally, supply port 300 is opened and the ink tank is flushed with liquid to remove the remaining ink, d) a new capillary media 500 is inserted into the enclosure 604 through opening 403 in the lid 603, e) the ink tank is oriented so that ink can be filled into the tank 102 through the supply port 300, f) the supply port 300 is closed, and g) the groove 612 and opening 403 from the enclosure or holding area 604 in the lid 603 are overlaid with a protective cover to provide a vent 614 to atmosphere.

In a second alternative embodiment for reusing the ink tank, step d), involving insertion of the capillary media into the enclosure or holding area, can occur after step f) and before step g) shown above. In other words, the ink tank 102 can be filled without the capillary media 500 inserted into the enclosure or holding area 604 and the capillary media 500 can be inserted prior to sealing the lid 603 with protective cover 900. This method of reuse of an ink tank has the advantage that the ink tank can be refilled without the need to break the bond joint between the ink tank and lid. Furthermore, the ink tank can be refilled without introducing ink into the capillary media.

Figure 6:
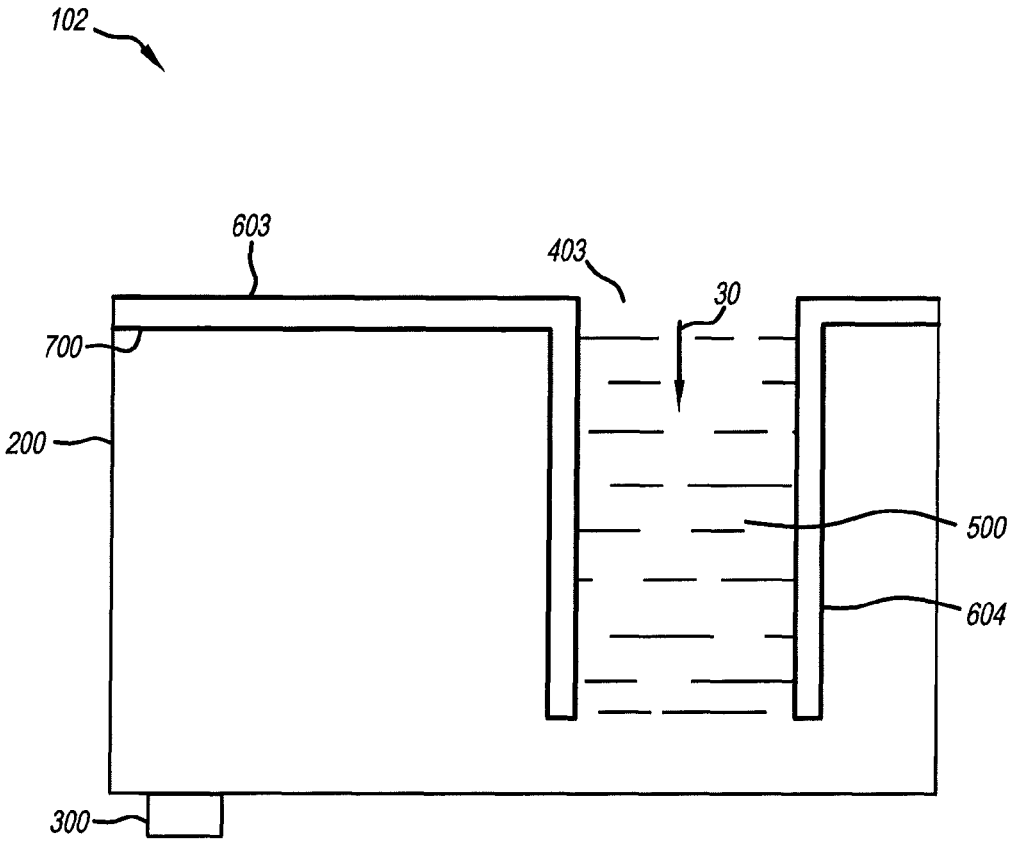
FIG. 6 is a view of a further embodiment of an ink tank in accordance with the present invention.

FIG. 6 illustrates a further embodiment of an ink tank in accordance with the present invention. In the embodiment of FIG. 6, the lid 603 forms enclosure or holding area 604, however, unlike the embodiment of FIG. 3, in the embodiment of FIG. 6, the walls 604*a* of the enclosure or holding area 604 does not include a section with holes 606. Therefore, in FIG. 6, the capillary media 500 is positioned within the walls 604*a* and held within enclosure or holding area 604 by way of, for example, a friction type fit between the capillary media 500 and the walls 604*a*. As in the previous embodiment, enclosure or holding area 604 can be tubular shape or take on a shape that permits that insertion or removal of capillary media 500 to or from the enclosure or holding area 604 while the lid 603 is bonded to the ink tank body 200 through bond 700. During use, opening 403 would be closed by use of cover 900 as shown in FIG. 4. Further, refilling of ink tank body 200 would be similar to the process described relative to FIG. 3 with the requirement that that capillary media be inserted within enclosure or holding area 604 prior to the filling of the ink tank body 200 with ink. Therefore, the embodiment of FIG. 6 can realize the advantages described above with respect to the embodiments of FIGS. 3, 4 and 5.

Figure 7:
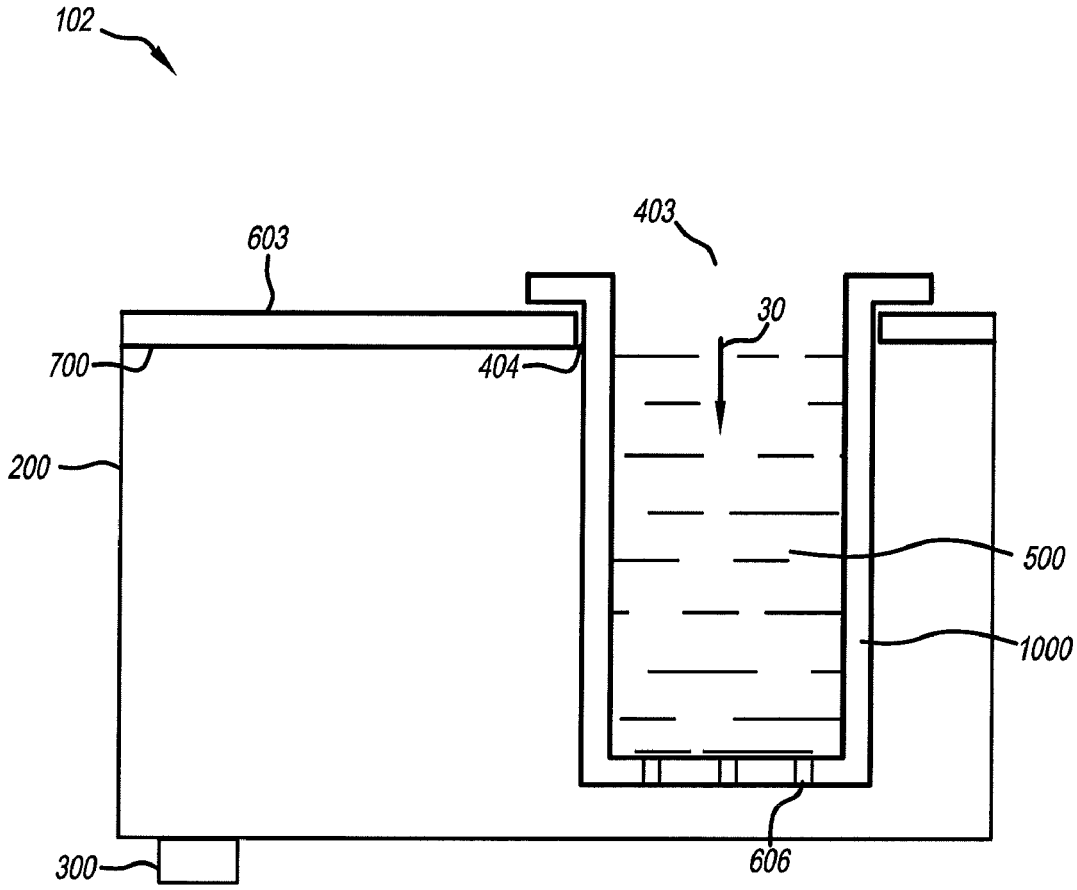
FIG. 7 is a view of a further embodiment of an ink tank in accordance with the present invention.

FIG. 7 illustrates a further embodiment of an ink tank in accordance with the present invention. In the embodiment of FIG. 7, the enclosure or holding area (identified in the previous embodiments by reference numeral 604) takes the form of a capillary cartridge or holding area unit 1000. Therefore, in FIG. 7, the ink tank lid 603 comprises a first opening 404 that is sized to receive capillary cartridge or holding area unit 1000 in a removable manner as a single unit. The capillary cartridge or holding area unit 1000 includes opening 403 in the form of a second opening that is sized to permit the insertion and/or removal of capillary media 500. Accordingly, in the embodiment of FIG. 7, the capillary media 500 along with the capillary cartridge or holding area unit 1000 can be removed together through opening 404 as part of the refilling or manufacturing process, while the lid 603 is bonded onto ink tank body 200. Also, as in the previous embodiments, the capillary media 500 can be removed and or inserted through opening 403 while the lid 603 is bonded onto the ink tank body 200. Therefore, the embodiment of FIG. 7 can realize the advantages described above with respect to the embodiments of FIGS. 3, 4 and 5. The embodiment of FIG. 7 further provides the option of changing the capillary cartridge or holding area unit 1000 as a unit when necessary while the lid 603 remains bonded to the ink tank body 200.

The invention has been described with reference to a preferred embodiment. However, it will be appreciated that variations and modifications can be effected by a person of ordinary skill in the art without departing from the scope of the invention.

The invention claimed is:

1. A method of manufacturing an ink tank comprising the steps of:

(a) attaching an ink tank lid to an ink tank body so as to form an enclosure therein, said ink tank body having a supply port;

(b) providing for an opening on said ink tank lid that leads to a holding area, wherein a wall that defines said holding area forms a boundary between said enclosure and said holding area;

(c) inserting a capillary media into said holding area through said opening; and (d) filling said enclosure with ink through said supply port;

wherein at least said step (c) is performed with the ink tank lid attached to the ink tank body.

2. A method according to claim 1, wherein after said enclosure is filled with ink, the method further comprises the steps of:

(e) closing said supply port; and (f) providing a removable seal over said opening.

3. A method according to claim 1, wherein said attaching step comprises forming a bond joint between said ink tank body and said ink tank lid through a vibration weld or a laser weld between the ink tank body and the ink tank lid.

4. A method of refilling an ink tank where ink in the ink tank has been previously consumed by a user, the ink tank having an ink tank lid that is bonded to an ink tank body, the method comprising the steps of:

(a) removing a protective cover from the ink tank lid, the ink tank lid comprising an opening which leads to a holding area, said holding area containing a capillary media therein;

(b) removing the capillary media from said holding area through said opening in said ink tank lid;

(c) inserting a new capillary media into said holding area through said opening; and (d) refilling the ink tank with ink through a supply port on the ink tank body;

wherein at least steps (a) through (d) are performed with said ink tank lid being bonded to said ink tank body.

5. A method according to claim 4, further comprising the steps of:

(e) closing the supply port; and (f) applying a new protective cover over said ink tank lid;

wherein steps (e) to (f) are performed with said ink tank lid being bonded to said ink tank body.

6. A method according to claim 4, wherein after said step (c) and before said step (d), the method further comprises:

(c1) flushing the ink tank body with a flushing liquid introduced into said ink tank body through at least one of the supply port or a vent to remove any remaining ink in the ink tank body, said step (c1) being performed with said ink tank lid being bonded to said ink tank body.

7. A method of refilling an ink tank where ink in the ink tank has been previously consumed by a user, the ink tank having an ink tank lid that is bonded to an ink tank body, the method comprising the steps of:

(a) removing a capillary media from a holding area defined by said ink tank lid through an opening in said ink tank lid;

(b) inserting a new capillary media into said holding area through said opening; and (c) refilling the ink tank with ink through a supply port on the ink tank body;

wherein said steps (a) through (c) are performed with said ink tank lid being bonded to said ink tank body.

* * * * *